US011903459B2

(12) United States Patent
Schlichtig et al.

(10) Patent No.: US 11,903,459 B2
(45) Date of Patent: Feb. 20, 2024

(54) WEARABLE OBJECT COMPRISING A CASE, A REMOVABLE BRACELET AND A SYSTEM FOR FASTENING THE BRACELET TO THE CASE

(71) Applicant: ETA SA Manufacture Horlogère Suisse, Grenchen (CH)

(72) Inventors: Dohan Schlichtig, Olten (CH); Roger Willemin, Grenchen (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 0 days.

(21) Appl. No.: 17/817,746

(22) Filed: Aug. 5, 2022

(65) Prior Publication Data

US 2023/0189941 A1 Jun. 22, 2023

(30) Foreign Application Priority Data

Dec. 20, 2021 (EP) ..... 21216076

(51) Int. Cl.
*A44C 5/14* (2006.01)
*A44C 5/20* (2006.01)

(52) U.S. Cl.
CPC ..... *A44C 5/14* (2013.01); *A44C 5/2071* (2013.01)

(58) Field of Classification Search
CPC ..... A44C 5/14; A44C 5/2071; A44C 5/147; G04B 37/1486; A44B 11/2596; C08L 77/02; C08L 101/00
See application file for complete search history.

(56) References Cited

U.S. PATENT DOCUMENTS 9,357,817 B2 * 6/2016 Lee ..... A44C 5/14
9,877,549 B2 * 1/2018 Perkins ..... A44B 11/263
(Continued)

FOREIGN PATENT DOCUMENTS

CN 106539207 A 3/2017

OTHER PUBLICATIONS

European Search Report dated May 31, 2022 in European Application 21216076.6 Filed on Dec. 20, 2021 (with English Translation of Categories of Cited Documents), 4 pages.
(Continued)

*Primary Examiner* — Robert Sandy
*Assistant Examiner* — Louis A Mercado
(74) *Attorney, Agent, or Firm* — Oblon, McClelland, Maier & Neustadt, L.L.P.

(57) ABSTRACT

A wearable object including a middle of a case, a bracelet, and a fastening system for removably securing the bracelet to the middle, the middle including two longitudinal cavities configured to form a slide-bar and receive a hooking head of the bracelet of complementary shape and configured to cooperate by sliding. The fastening system includes elastic casing elements to bolt the axial movement of the hooking head inside the longitudinal cavity, the elastic casing elements including: a rigid bolting protrusion, arranged on an inner wall of each of the longitudinal cavities, cooperating with; two obstacles arranged in the vicinity of an elastic portion of the hooking heads, the obstacles delimiting an inter-obstacle space designed to receive the bolting protrusion and form locking elements of the bolting protrusion; the elastic casing elements being configured to elastically distort the elastic portion of the hooking head during the insertion of the bracelet.

17 Claims, 4 Drawing Sheets

(56) References Cited

U.S. PATENT DOCUMENTS

| | | | | |
|---|---|---|---|---|
| 10,123,593 | B2 * | 11/2018 | Perkins | H05K 999/99 |
| 10,182,623 | B2 * | 1/2019 | Perkins | A44B 11/263 |
| 2014/0083133 | A1 | 3/2014 | Lee et al. | |
| 2018/0125178 | A1 | 5/2018 | Perkins et al. | |
| 2021/0393003 | A1 * | 12/2021 | Taton | A44C 5/145 |
| 2023/0119270 | A1 * | 4/2023 | Cazalet | A44C 5/147<br>368/282 |

OTHER PUBLICATIONS

Office Action dated Sep. 5, 2023, in Japanese Patent Application No. 2022-134702 with English translation, citing document 1 therein, 6 pages.

* cited by examiner

WEARABLE OBJECT COMPRISING A CASE, A REMOVABLE BRACELET AND A SYSTEM FOR FASTENING THE BRACELET TO THE CASE

CROSS-REFERENCE TO RELATED APPLICATION

This application claims priority to European Patent Application No. 21216076.6 filed on Dec. 20, 2021, the entire disclosure of which is hereby incorporated herein by reference.

TECHNICAL FIELD OF THE INVENTION

The present invention relates to a wearable object comprising a case and a bracelet connected to the case, intended to be worn on the user's wrist. The invention relates more specifically to a removable fastening device of the bracelet to the case of the wearable object, enabling the fitting and dismantling of the bracelet without using a tool.

The invention relates more specifically to a wristwatch comprising a watch case and a bracelet connected to said watch case, via a removable fastening device of the bracelet to the watch case.

TECHNOLOGICAL BACKGROUND

Fastening devices for fastening a bracelet to a watch case are generally quite complex, both in terms of the number of different parts required for assembly and of the complexity of these parts as well as the manufacturing difficulty thereof.

In particular, the ends of each strand of the bracelet as well as the watch case must be specially shaped, machined, to be able to be assembled. Furthermore, the fitting of these different elements is quite time-consuming and hence costly.

Usual fastening devices are based on the presence of two horns, or other addendum elements, arranged on the rim of the middle of the watch case, a transverse bar inserted at the end of a bracelet strand, each end of the transverse bar being inserted into an orifice arranged at each horn.

This type of fastening of a bracelet on a watch case requires the use of a specific tool for the interchangeability of the bracelet. Consequently, if the user wishes to change their bracelet for wear or aesthetic reasons, they are generally obliged to go to a professional to perform this replacement operation. This operation thus requires time and incurs a certain cost.

From an industrial point of view, the horns, or other elements, acting as addenda on the rim of the middle prevent the automation of numerous operations during the manufacture of the watch case or during the finish. Thus, some operations need to be carried out manually in order to avoid damaging the horns or other addendum elements.

Fastening devices for facilitating bracelet interchangeability are known. However, these fastening devices are generally complex to produce and require the use of interposed parts between the strand of the bracelet and the watch case to ensure the bolting of the bracelet, such as for example springs, strips, etc.

Furthermore, fastening devices providing simplified bracelet interchangeability require substantial modifications of the watch case and/or the bracelet without for all that facilitating the method of manufacturing these elements, which incurs additional costs during manufacture.

Consequently, there is a need to enhance removable fastening devices of a bracelet to a watch case, and more generally a bracelet to a wearable object, in order to resolve at least one of the known limitations described above.

SUMMARY OF THE INVENTION

In this context, the aim of the invention is that of providing a removable fastening device of a bracelet to a case of a wearable object having a simple, inexpensive design, not requiring any interposed part between the bracelet and the case of the wearable object to ensure elastic coupling and bolting. Thus, the invention offers a "one-piece" solution not requiring the use of additional parts for casing and bolting the bracelet in position on the case.

The aim of the invention is also that of providing a fastening device enabling simple fitting and dismantling of the bracelet on the case without using a tool. Thus, the user can change their bracelet easily in the event of wear, or to modify the aesthetics, without needing a professional.

The aim of the invention is also that of providing a fastening device enabling easy manufacture of the parts, such that the bracelet and the case can be fully automated by conventional means and do not require any manual correction operation of the fastening device.

The fastening device according to the invention makes it possible to provide a case where the middle is devoid of horns, and of addendum elements for fitting the bracelet, which makes it possible to obtain a symmetrical and readily automatable case.

For this purpose, the invention relates to a wearable object comprising a case having a middle, a bracelet, and a fastening system for removably securing each end of said bracelet to said middle, said middle comprising two longitudinal cavities configured to form a slide-bar, each end of said bracelet comprising a hooking head of complementary shape and configured to cooperate by sliding with one of the longitudinal cavities to form the fastening system, said wearable object being characterised in that the fastening system comprises elastic casing elements to lock the axial movement of said hooking head inside said longitudinal cavity, the elastic casing elements comprising:

- a rigid bolting protrusion, arranged on an inner wall of each of the longitudinal cavities, cooperating with;
- two obstacles arranged in the vicinity of an elastic portion of the hooking heads, said obstacles delimiting an inter-obstacle space designed to receive said bolting protrusion and form locking elements of said bolting protrusion;
- the elastic casing elements being configured to elastically distort said elastic portion of the hooking head during the insertion of the bracelet, so as to allow the passage of said bolting protrusion beyond the obstacles and lock said bolting protrusion in the inter-obstacle space bolting the axial movement of said hooking head by elastic return of the elastic portion.

Besides the features mentioned in the paragraph above, the wearable object according to the invention can have one or more of the following additional features, considered individually or according to any technically possible combinations:

- the elastic casing elements are configured to elastically distort said elastic portion of the hooking head in the direction of the bottom of the longitudinal cavity;
- the elastic portion of the hooking heads is a zone of lesser thickness formed by a hollow arranged at the end of the hooking heads;

the hooking heads comprise a groove designed to receive the bolting protrusion, said two obstacles being arranged in said groove;

said groove is arranged at a bottom surface of the hooking heads;

the two obstacles arranged in the vicinity of the elastic portion of the hooking heads have a ramp shape wherein the thicker portions of the ramps delimit the inter-obstacle space;

the two ramp-shaped obstacles have an inclined plane oriented in the direction of sliding of the hooking head in the longitudinal cavity;

the elastic casing elements are configured to be reversible and enable the release of the axial position of the hooking heads without damaging one of the elements forming said elastic casing elements;

the bracelet comprises two strands, each strand comprising a hooking head forming the end of the strand, the hooking being integral with said strand of the bracelet;

the hooking heads are made of polymeric material, preferably of thermoplastic material;

the hooking heads are made of thermoplastic elastomer;

said middle of the case is made of thermoplastic, preferably of polyamide 11;

the fastening system is configured to enable the fitting of the bracelet either by a first end or by a second end of the longitudinal cavity;

the longitudinal cavities extend over two circular segments of the middle located at 6 o'clock and at 12 o'clock.

Advantageously, the wearable object is a wristwatch.

BRIEF DESCRIPTION OF THE FIGURES

The aims, advantages and features of the present invention will emerge on reading the following detailed description with reference to the following figures:

FIG. 4 being a perspective view illustrating more specifically the top surface of the strand, and FIG. 5 being a perspective view illustrating more specifically the bottom surface of the strand;

In all the figures, common elements bear the same reference numbers unless specified otherwise.

DETAILED DESCRIPTION OF THE INVENTION

Figure 1:
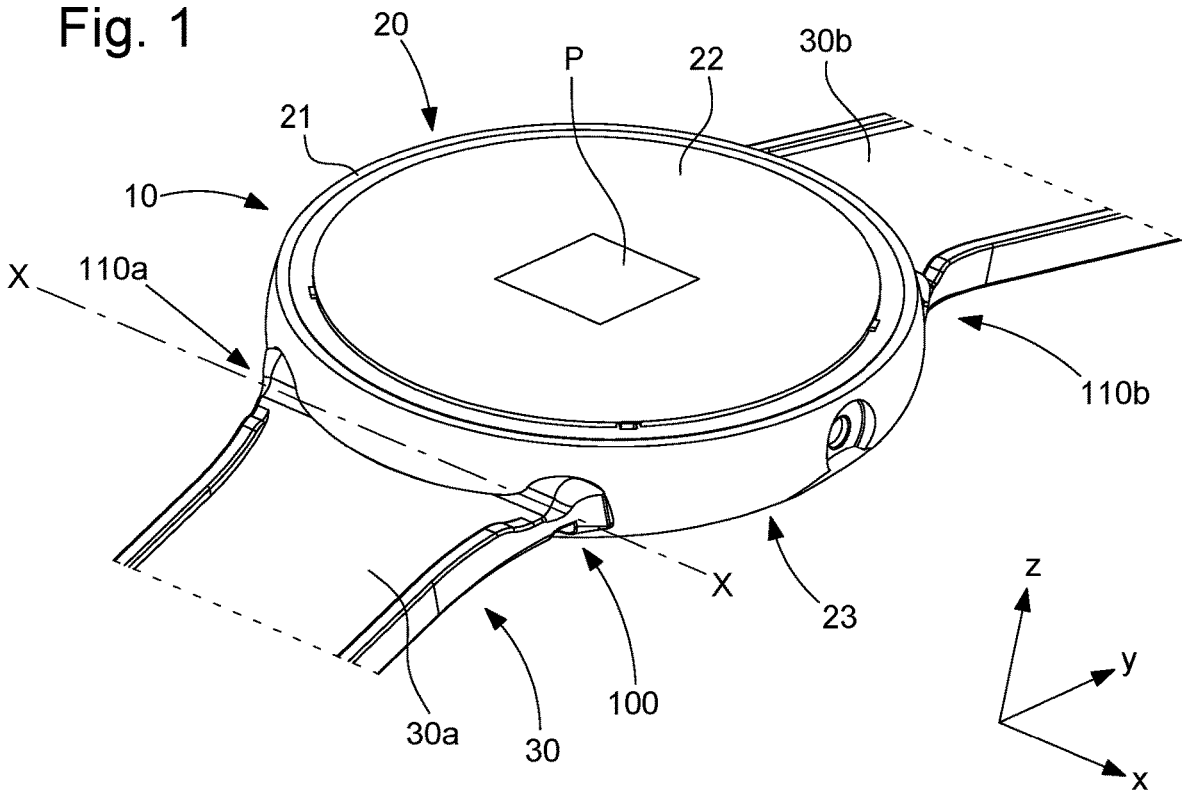
FIG. 1 represents a first perspective view, of an embodiment example of a wearable object according to the invention.

FIG. 1 illustrates a first perspective view, of an embodiment example of a wearable object 10 according to the invention. This wearable object here takes the form of a timepiece, such as a wristwatch intended to be worn on the user's wrist. It is also understood that the wearable object 10 can be, for example, a pedometer, a heart rate monitor, or any other wearable object intended to be worn by means of a bracelet, for example on the wrist.

Figure 2:
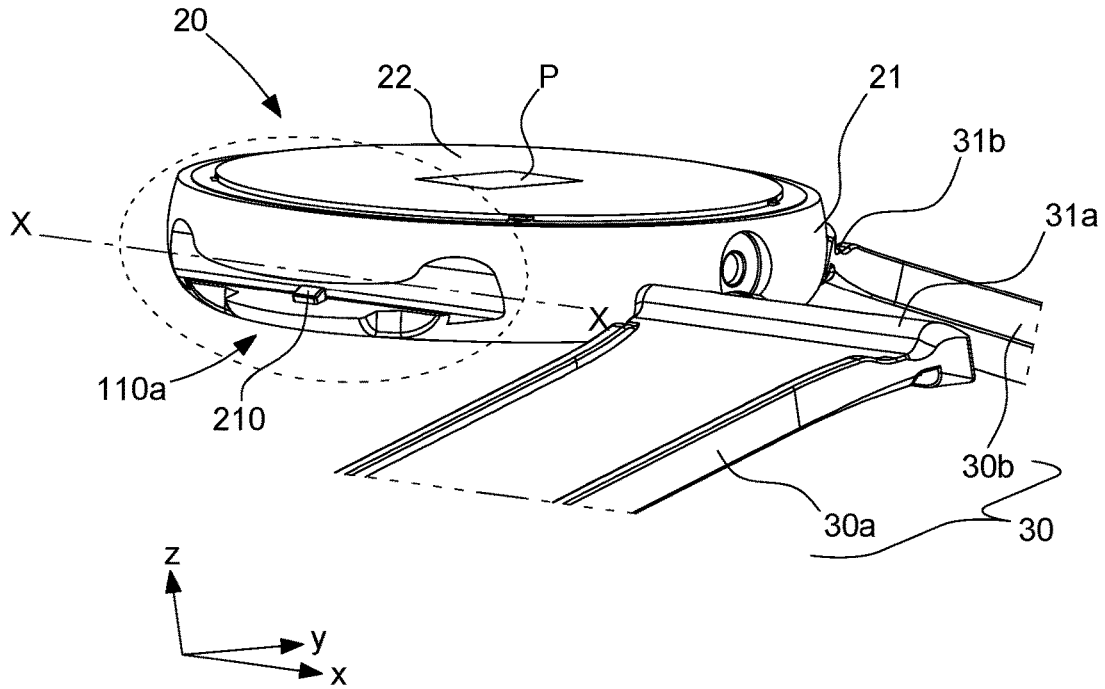
FIG. 2 illustrates a second perspective view of the embodiment example of the wearable object according to the invention, wherein a bracelet strand is represented not cased in the middle.

FIG. 2 illustrates a second perspective view of the embodiment example of the wearable object 10 according to the invention, wherein a bracelet strand is represented not cased in the middle.

Figure 2A:
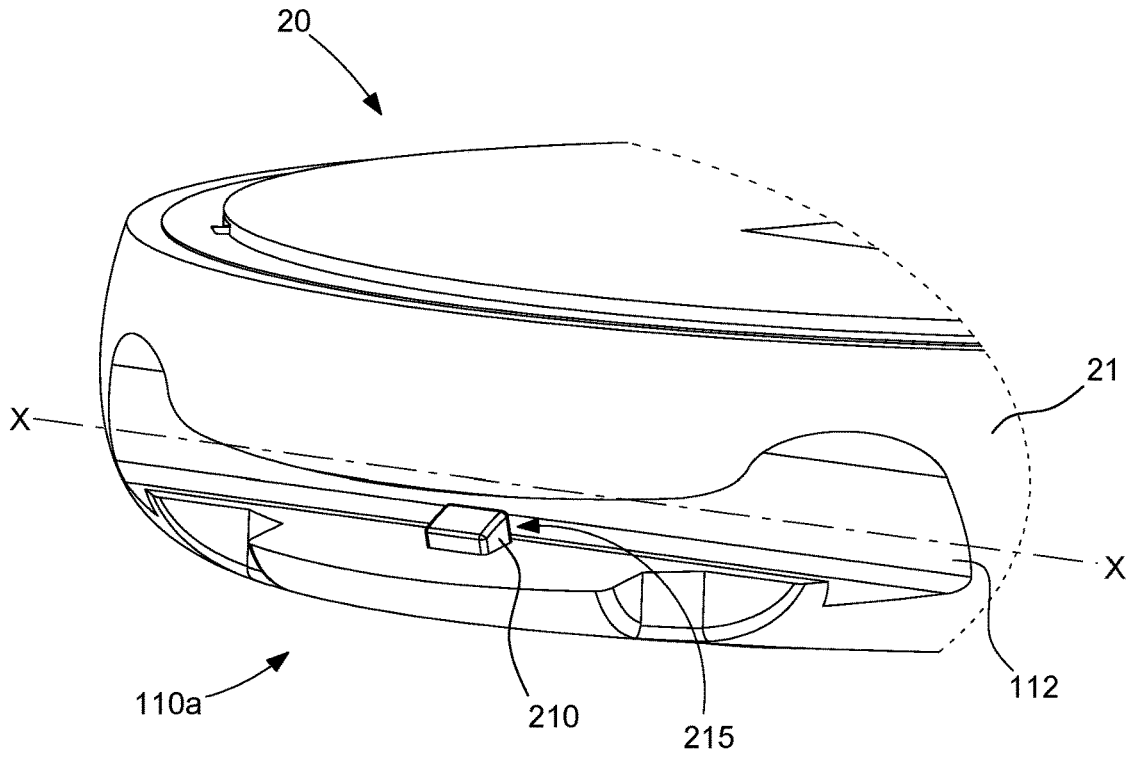
FIG. 2*a* is an enlargement of a portion of FIG. 2 illustrating in a more detailed way a middle portion comprising a longitudinal cavity.

FIG. 2*a* is an enlargement of a portion of FIG. 2 illustrating in a more detailed way a middle portion comprising a longitudinal cavity;

The wearable object 10 comprises a case 20, intended to receive for example a horological movement (not shown here for clarity purposes). The horological movement carries and drives elements for displaying information, for example the current time.

The case 20 consists of a middle 21 closed by a back 23 at the bottom part and by a crystal 22 in the top part. The case 20 can also comprise a bezel (not shown) fitted on the middle 21 and capable of carrying the crystal 22, the bezel being optionally rotating.

The case 20 defines a principal plane P seen, for example in FIG. 1, having a transverse axis x and longitudinal axis y. The axis z extends perpendicularly to the plane P, and defines the axis of the thickness of the case 20. The plane P is advantageously parallel with the plane part of a plate comprised in the horological movement.

In the embodiment example illustrated, the transverse axis x is parallel with the 3-9 o'clock axis and the longitudinal axis y is parallel with the 6-12 o'clock axis.

The case 20 illustrated by way of example has a general circular shape. However, the case 20 can have other known embodiments without leaving the context of the invention.

The wearable object 10 also comprises a flexible, removable bracelet 30, two ends of which are intended to be removably coupled with the middle 21 of the case 20, via a fastening system 100. The fastening system 100 makes it possible to secure the bracelet 30 to the case 20, bolt it in position, and enables easy interchangeability of the bracelet 30, without using a tool.

The fastening system 100 makes it possible to perform elastic casing of the bracelet 30, reversibly, as opposed to a so-called irreversible elastic casing system, requiring the destruction or damage of at least one of the elements forming the fastening system during the disassembly of the bracelet 30 of the case 20.

The bracelet 30 is presented in the form of two strands 30*a*, 30*b* connected to one another by a closing device (not shown), for example a clasp, a deploying loop or any other ad-hoc element for carrying out this attachment function of the two strands 30*a*, 30*b* of the bracelet 30 around the user's wrist.

According to an alternative embodiment, the bracelet 30 is single-stranded.

The middle 21 comprises two longitudinal cavities 110*a*, 110*b* configured to receive the end of each strand 30*a*, 30*b* of the bracelet 30, and more specifically of hooking heads 31*a*, 31*b* forming the ends of each strand 30*a*, 30*b* of the bracelet 30. A first longitudinal cavity 110*a* is represented more specifically in an enlarged view in FIG. 2.

The longitudinal cavities 110*a*, 110*b* are arranged in the middle 21 and advantageously replace the fastening horns routinely used for fastening the bracelet. The longitudinal cavities 110*a*, 110*b* cooperate with the hooking heads 31*a*,

31*b* of the strands 30*a*, 30*b* of the bracelet 30 to form the fastening system 100 of the bracelet 30.

Thus, it is observed that the middle 21 of the case 20 according to the invention comprises no addendum element for fastening the bracelet 30. For this reason, the manufacture of the case 20 can be carried out in a fully automated fashion.

The longitudinal cavities 110*a*, 110*b* are created at two fastening portions, opposite one another, located on either side of a dial (not shown), and advantageously located at 6 o'clock and at 12 o'clock.

The longitudinal cavities 110*a*, 110*b* extend over two circular segments of the middle 21 located at 6 o'clock and at 12 o'clock.

The longitudinal cavities 110*a*, 110*b* form slide-bars extending along a longitudinal axis forming a sliding axis X-X, parallel with the transverse axis x of the case 20.

The longitudinal cavities 110*a*, 110*b* are configured to receive the hooking heads 31*a*, 31*b* of the strands 30*a*, 30*b* of the bracelet 30 and to guide the hooking heads 31*a*, 31*b* in translation, along the sliding axis X-X, during the fitting and dismantling of the bracelet 30.

Thus, the strands 30*a*, 30*b* are fitted on the middle 21 by sliding the hooking heads 31*a*, 31*b* in the longitudinal cavities 110*a*, 110*b* of the middle 21.

The longitudinal cavities 110*a*, 110*b* are through, i.e. they are open at a first end and a second end, such that it is possible to insert and remove the bracelet 30 by sliding both by the first end and by the second end of the longitudinal cavities 110*a*, 110*b*, i.e. by the end located on the crown side (3 o'clock side) or by the end located on the side opposite the crown (9 o'clock side).

The hooking heads of the strands 30*a*, 30*b* have a complementary shape adapted to fit in the longitudinal cavities 110*a*, 110*b* and to cooperate by rectilinear sliding, along the sliding axis X-X, in the longitudinal cavities 110*a*, 110*b*.

Figure 3:
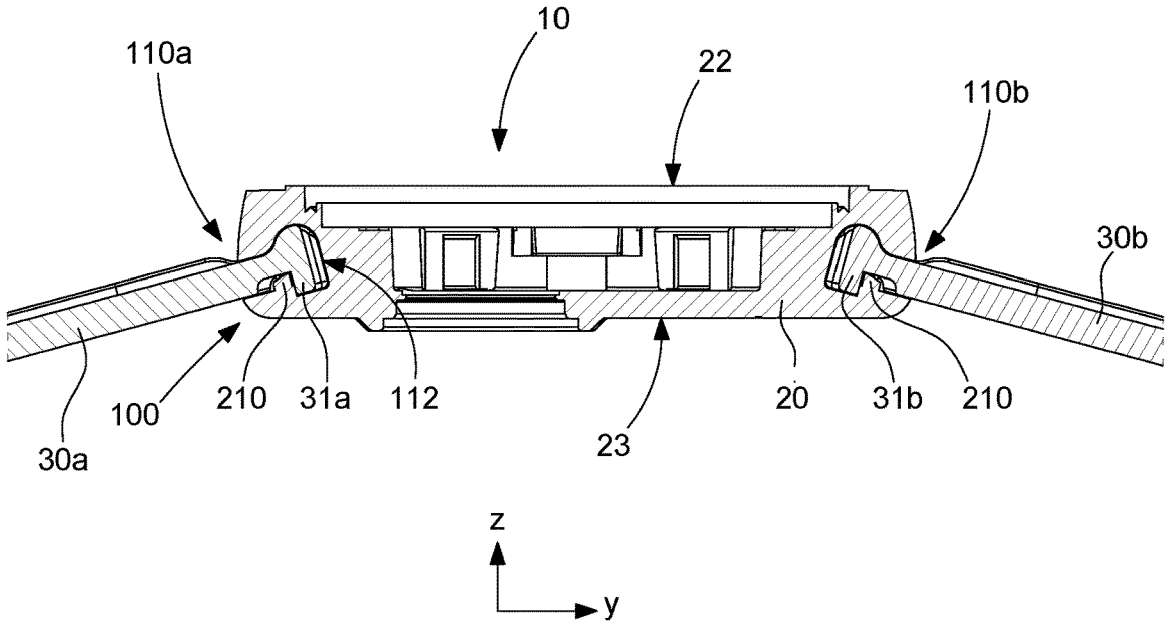
FIG. 3 represents a section of the wearable object, along the plane y, z of the case making it possible to illustrate the cross-section of the longitudinal cavities and the hooking heads locked in the longitudinal cavities.

FIG. 3 represents a section of the wristwatch 10, along the plane y, z making it possible to illustrate the cross-section of the longitudinal cavities 110*a*, 110*b* and the hooking heads 31*a*, 31*b* bolted in the longitudinal cavities 110*a*, 110*b*.

It is thus noted that the longitudinal cavities 110*a*, 110*b* have a substantially hook-shaped cross-section. Advantageously, the longitudinal cavities 110*a*, 110*b* have a counter-relief portion for locking the movements of the bracelet except for the translation movements along the sliding axis X-X, corresponding to the longitudinal axis of the longitudinal cavities 110*a*, 110*b*.

Such a shape advantageously makes it possible to allow a translation of the strands 30*a*, 30*b* in the longitudinal cavities 110*a*, 110*b* by sliding while locking the other degrees of freedom by the presence of an additional material thickness at the end of the hooking heads 31*a*, 31*b*, with respect to the strands 30*a*, 30*b*.

Obviously other embodiments are also contemplated. For example, the longitudinal cavities 110*a*, 110*b* and the complementary hooking heads can have a circular, L-shape, T-shaped, C-shaped cross-section, etc.

The fastening system 100 furthermore comprises elastic casing elements for securing and bolting the axial movement of each strand 30*a*, 30*b* in the longitudinal cavities 110*a*, 110*b* of the middle 21, to bolt the position of each strand 30*a*, 30*b* in a so-called bolting position.

The elastic casing elements are elastic casing elements configured to perform reversible elastic casing of the hooking heads 31*a*, 31*b* of the strands 30*a*, 30*b* on the middle 21, by clipping/unclipping.

The elastic casing elements comprise a bolting protrusion 210, seen specifically in FIG. 2, such as for example a blom stud or a finger. The bolting protrusion 210 is rigid and centred in each longitudinal cavity 110*a*, 110*b*, with respect to the sliding axis X-X.

Advantageously, the bolting protrusion 210 is integral with the middle 21.

The bolting protrusion 210 is configured to cooperate with a groove 220 arranged at a bottom surface of the hooking heads 31*a*, 31*b* of the strands 30*a*, 30*b*. During the fitting of the bracelet 30, the bolting protrusion 210 is inserted into the groove 220. The groove 220 is designed to receive the bolting protrusion 210.

In the embodiment example illustrated by way of example, the groove 220 is arranged at a bottom surface of the hooking heads 31*a*, 31*b*; however, it is also possible without deviating from the context of the invention to produce said groove at a top surface of the hooking heads by modifying the shape of the cross-section of the heads, for example by inverting the shape of the hook, and by modifying the position of the bolting protrusion 210 so as to cooperate with the groove.

Figure 4:
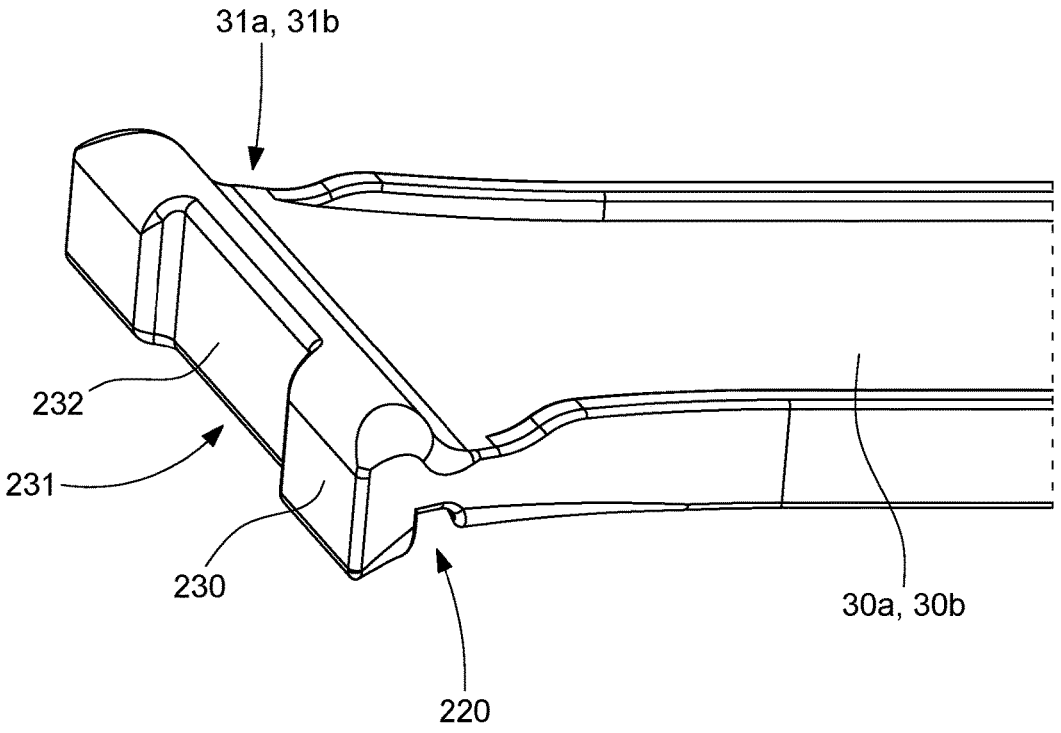
FIG. 4 and FIG. 5 illustrate more specifically a strand of the bracelet at the hooking head.
Figure 5:
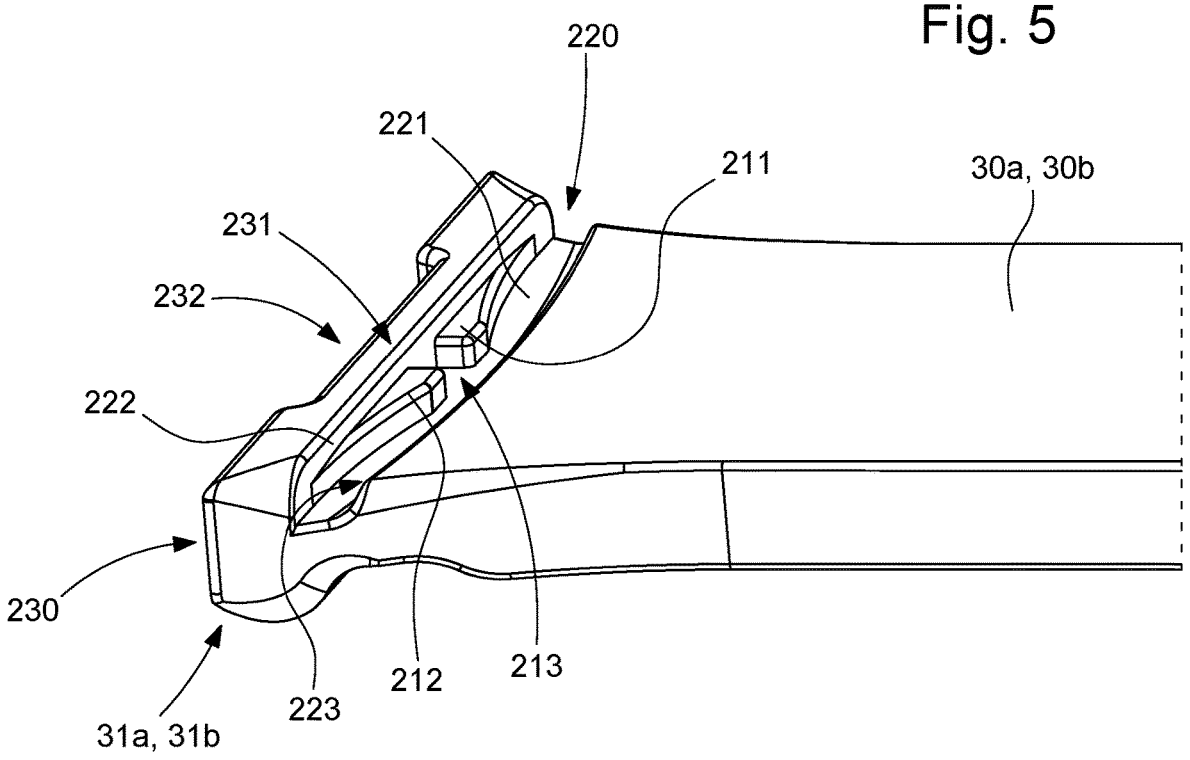

FIG. 4 and FIG. 5 more specifically illustrate a strand 30*a*, 30*b* of the bracelet 30 at the hooking head 31*a*, 31*b*. FIG. 4 is a perspective view more specifically illustrating the top surface of the strand 30*a*, 30*b*, and FIG. 5 is a perspective view more specifically illustrating the bottom surface of the strand 30*a*, 30*b*.

It is obvious that the term bottom surface of the strand of a bracelet denotes the surface intended to come at least partially in contact with the user's skin, and the surface opposite the bottom surface is considered as the top surface of the strand.

The groove 220 is delimited by a bottom 221, and two lateral faces 222, 223.

A first lateral face 222 is substantially planar whereas the second lateral face 223 is curved so as to cooperate with the circular shape of the middle 21.

The first lateral face 222 is located at a certain distance from an end lateral face 230 of the hooking heads 31*a*, 31*b* and oriented substantially in a parallel manner.

The groove 220 carries two obstacles 211, 212 configured to cooperate with the bolting protrusion 210, so as to elastically distort an elastic portion 231 of the hooking heads 31*a*, 31*b* under the stress generated by the passage of the protrusions over the obstacles during the fitting of a strand 30*a*, 30*b* in a longitudinal cavity 110*a*, 110*b*.

Advantageously, the obstacles 211, 212 are arranged in the vicinity of the elastic portion 231 of the hooking heads 31*a*, 31*b*, the elastic portion 231 being a portion intended to be distorted during the passage of the bolting protrusion 210 over the obstacles 211, 212.

Advantageously, the obstacles 211, 212 are ramps. However, other shapes are contemplated.

The ramps 211, 212 are arranged so as to protrude in relation to the first lateral face 222.

The ramps 211, 212 are positioned such that the thickest portions are directed towards a median region of the groove 220. Thus, the thickest positions of the two ramps 211, 212 face one another.

An inter-obstacle space 213 is delimited between the two ramps 211, 212. This inter-obstacle space 213 is arranged between the thickest portions of the ramps and is intended to receive the bolting protrusion 210 and to form locking elements to lock the axial movement of the strand 30*a*, 30*b* in the longitudinal cavity 110*a*, 110*b*.

The bolting protrusion 210 cooperates with the inter-obstacle space 213 to form the elastic casing elements of the bracelet 30 and to lock the axial movement of the hooking head 31*a*, 31*b* by elastic return of the elastic portion 231 when the bolting protrusion 210 is positioned in the inter-obstacle space 213.

The inclined plane of each ramp 211, 212 extends along the longitudinal axis of the groove 220. The inclined plane can be curved or planar. Advantageously, the inclined plane of each ramp is curved so as to increase the fitting stress in the vicinity of the locking at the start of fitting, during the insertion of the bracelet 30 into each longitudinal cavity 110*a*, 110*b*.

The elastic portion 231 of the hooking heads 31*a*, 31*b* is a zone of lesser thickness arranged at the end of the hooking heads 31*a*, 31*b*, such that the elastic casing elements elastically distort this elastic portion 231 by pushing the material towards the case 20 or the bottom 112 of the longitudinal cavity 110, 110*b*, substantially along the longitudinal axis y of the case 20.

The elastic portion 231 of the hooking heads 31*a*, 31*b* is arranged at the end lateral face 230 of the hooking heads 31*a*, 31*b*.

The end lateral face 230 has a central hollow 232 located at least partially facing the ramps 211, 212.

The central hollow 232 makes it possible to form the zone of lesser thickness at the end of the hooking heads 31*a*, 31*b*, and therefore the elastic portion 231.

During the sliding of the strand 30*a*, 30*b*, the bolting protrusion 210 progressively stresses the end portion of the hooking heads 31*a*, 31*b* by the cooperation of the ramps 211, 212 and the bolting protrusion 210, causing an elastic distortion of the elastic portion 231. The elastic distortion enables the passage of the bolting protrusion 210 beyond the ramps 211,212 and the bed of the bolting protrusion 210 in the inter-obstacle space 213.

The hooking heads 31*a*, 31*b* of each strand 30*a*, 30*b* of the bracelet 30 are advantageously made of a more flexible material than the middle 21 of the case 20 so as to enable the distortion of the elastic portion 231 during the fitting of the bracelet 30.

Advantageously, at least the hooking heads 31*a*, 31*b* of the bracelet 30 are made of polymer material, for example of thermoplastic material.

Advantageously, the hooking heads 31*a*, 31*b* are made of TPV (ThermoPlastic Vulcanizate), TPU (thermoplastic polyurethane), TPE (thermoplastic elastomer) or TPO (thermoplastic polyolefin) type thermoplastic elastomer. By way of example, the hooking heads 31*a*, 31*b* can be made of Opti-Flex™.

By way of example, the hooking heads 31*a*, 31*b* of the bracelet 30 can be made of the same or a different material as the rest of the strands 30*a*, 30*b* of the bracelet 30.

By way of example, the middle 21 is made of a metallic material or of polymer. By way of example, the middle 21 is made of thermoplastic. By way of example, the middle 21 can be made of polyamide 11, also known as polyundecanamide or nylon 11.

The middle 21 is advantageously a one-piece middle. However, it is also contemplated to produce a middle assembled from several separately manufactured parts.

Advantageously, the middle made of polymer is a one-piece middle produced by injection.

Figure 6A:
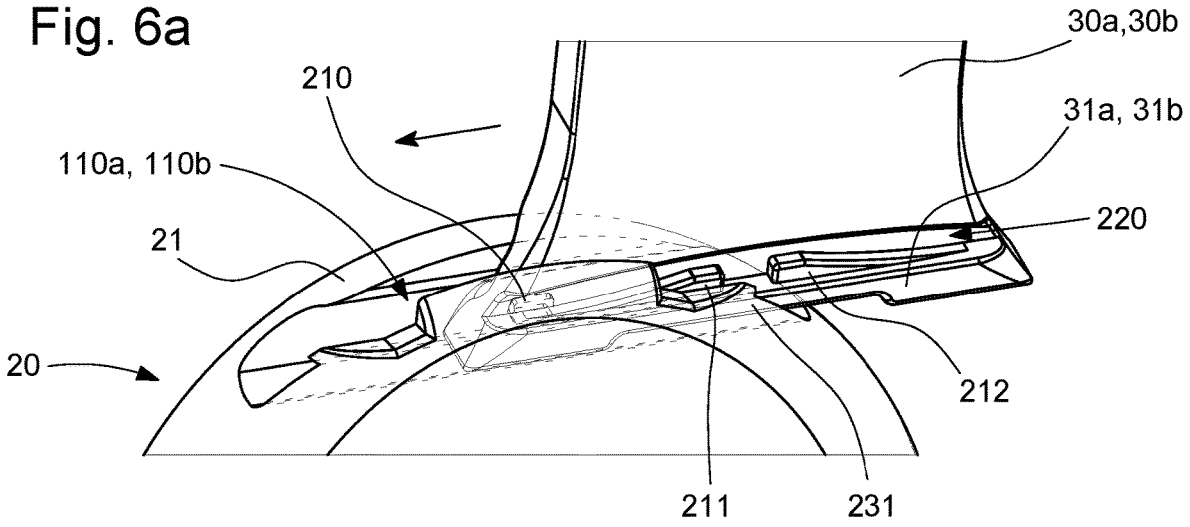
FIGS. 6*a* to 6*c* illustrate the different phases of fitting the bracelet onto the middle of the wearable object according to the invention.
Figure 6B:
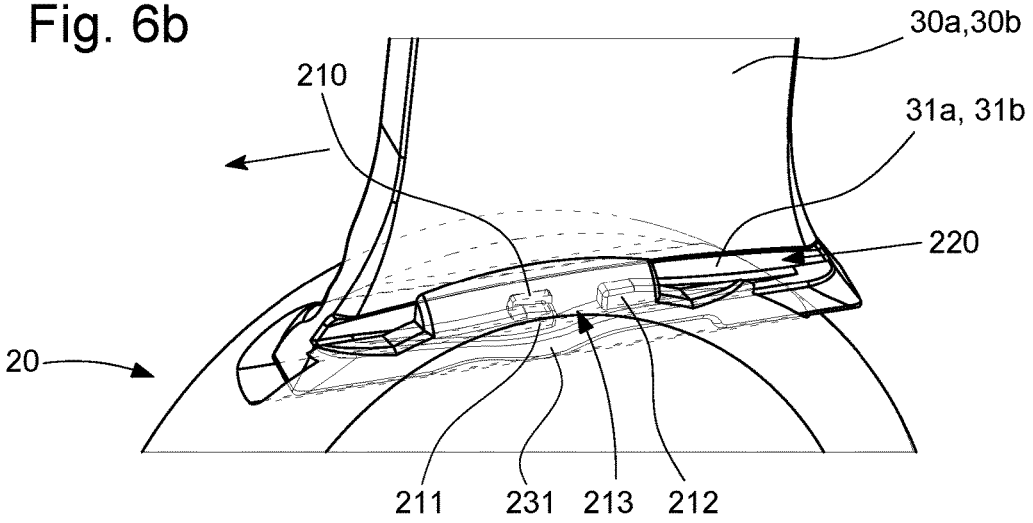
Figure 6C:
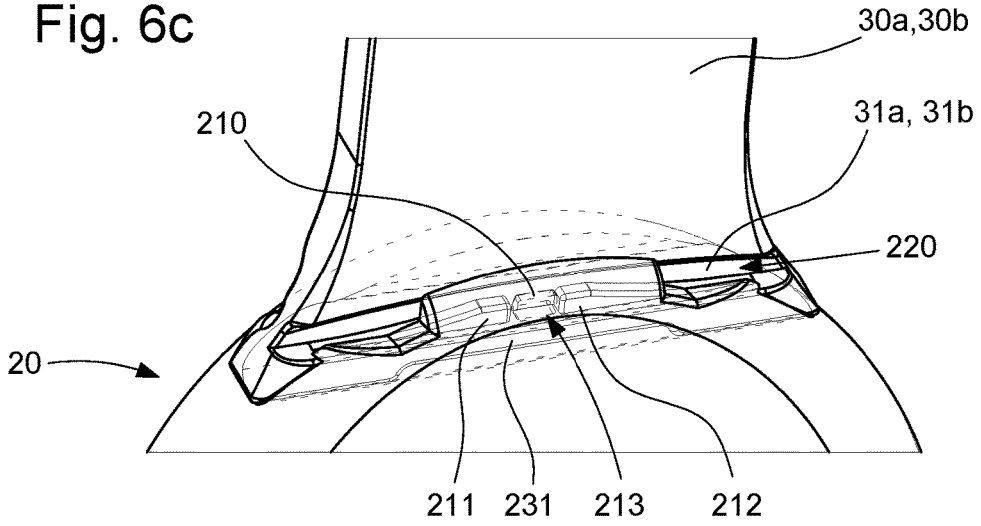

The fitting of the bracelet 30 onto the middle 21 of the case 20 is performed as follows. FIGS. 6*a* to 6*c* are used to illustrate the different fitting phases.

In a first phase, illustrated by FIG. 6*a*, each strand 30*a*, 30*b* is inserted into a longitudinal cavity 110*a*, 110*b* of the middle 21.

The longitudinal cavities 110*a*, 110*b* and the ramps 211, 212 being symmetrical, the bracelet 30 can be fitted either by a first end or by a second end of the longitudinal cavities 110*a*, 110*b*, i.e. by the end located on the crown side or by the end on the opposite side.

Each strand 30*a*, 30*b* is then slid into a longitudinal cavity 110*a*, 110*b* along the sliding axis X-X of the longitudinal cavity 110*a*, 110*b*, for example in the chosen fitting direction, for example in the direction indicated in FIG. 6*a*. During the insertion of the strand 30*a*, 30*b*, the bolting protrusion 210 is inserted into the groove 220. The bolting protrusion 210 has a contact face 215 in contact, or at least facing, with the first lateral face 222 of the groove 220. The contact face 215 of the bolting protrusion 210 then cooperates with the inclined plane of the ramp 211, 212 and slides thereon during the additional insertion of the strand 30*a*, 30*b* into the longitudinal cavity 110*a*, 110*b*.

This phase is illustrated more specifically in FIG. 6*b*.

By sliding on the inclined plane of the ramp 211, 212, and under the insertion stress supplied by the user, the bolting protrusion 210 progressively stresses the end of the hooking head 31*a*, 31*b* and more specifically the elastic portion 231 until elastic distortion of this zone of the hooking head 31*a*, 31*b* is achieved.

The play arranged between the elastic portion 231 and the bottom 112 of the longitudinal cavity 110*a*, 110*b* allows the material to be elastically distorted, which makes it possible to pass the ramp 211, 212 and position the bolting protrusion 210 in the inter-obstacle space 213, as illustrated in FIG. 6*c*.

Once the bolting protrusion 210 has been inserted into the inter-obstacle space 213, the bracelet 30 is then bolted in position in the case 20, the bolting protrusion 210 being locked laterally against the lateral walls of the ramps 211, 212.

To release the bracelet 30 and perform the dismantling thereof, the user must compress the end of the strand 30*a*, 30*b* against the case 20 so as to elastically distort the end of the hooking head 31*a*, 31*b*, and more specifically the central region where the inter-ramp space 213 is located, so as to bring the inclined plane of the ramps 211, 212 to the contact face 215 of the bolting protrusion 210 so as to release the latter from the inter-ramp space 213.

When the bolting protrusion 210 is no longer trapped in the inter-obstacle space 213, the strand 30*a*, 30*b* can be removed from the longitudinal cavity 110*a*, 110*b* by sliding by the first end or the second end, by exerting a translation along the sliding axis X-X.

The case and the system for fastening a bracelet to the case according to the invention make it possible to greatly facilitate the method for producing the case, as the latter is devoid of fastening horns and is entirely symmetrical. Thus, the manufacture of the case and the bracelet can be automated. The manufacturing costs of such an assembly and of such a wearable object are hence reduced, particularly by the lack of correction operation on the case and by the lack of use of additional elements, such as bars, for fastening the bracelet to the case.

The fastening system according to the invention advantageously makes it possible to avoid the use of additional or interposed parts between the bracelet and middle, such as bars, elastic clips, etc., or the need to use tools (whether they are specific or routinely used) for securing and/or disassembling the bracelet.

Furthermore, the fastening system according to the invention makes it possible to simplify bracelet interchangeability, which makes it possible to be able to readily renew the bracelet in the event of wear, or to modify the aesthetics, with a simple procedure, without using a tool and without damaging one of the elements of the fastening system during the disassembly of the bracelet.

The invention was been described with a specific embodiment of the case and the ends of the strands of the bracelet. However, it is obvious that other embodiments, as well as those derived from that described, are contemplated.

The invention claimed is:

1. A wearable object comprising:

a case having a middle, a bracelet, and a fastening system for removably securing each end of said bracelet to the middle, the middle comprising two longitudinal cavities configured to form a slide-bar, each of the end of the bracelet comprising a hooking head of complementary shape and configured to cooperate by sliding with one of the longitudinal cavities to form the fastening system, wherein the fastening system comprises elastic casing elements to bolt an axial movement of said hooking head inside the longitudinal cavity, the elastic casing elements comprising:

a rigid bolting protrusion, arranged on an inner wall of each of the longitudinal cavities, cooperating with;

two obstacles arranged in a vicinity of an elastic portion of the hooking heads, the obstacles delimiting an inter-obstacle space designed to receive the bolting protrusion and form locking elements of the bolting protrusion;

the elastic casing elements being configured to elastically distort the elastic portion of the hooking head during an insertion of the bracelet, so as to allow a passage of the bolting protrusion beyond the obstacles and lock the bolting protrusion in the inter-obstacle space bolting the axial movement of the hooking head by elastic return of the elastic portion, wherein the hooking heads comprise a groove designed to receive the bolting protrusion, the two obstacles being arranged in the groove.

2. The wearable object according to claim 1, wherein the elastic casing elements are configured to elastically distort the elastic portion of the hooking head in a direction of a bottom of the longitudinal cavity.

3. The wearable object according to claim 1, wherein the elastic portion of the hooking heads is a zone of lesser thickness formed by a hollow arranged at an end of the hooking heads.

4. The wearable object according to claim 1, wherein the groove is arranged at a bottom surface of the hooking heads.

5. The wearable object according to claim 1, wherein the two obstacles arranged in the vicinity of the elastic portion of the hooking heads have a ramp wherein thicker portions of the ramps delimit the inter-obstacle space.

6. The wearable object according to claim 5, wherein the ramps have an inclined plane oriented in a direction of sliding of the hooking head in the longitudinal cavity.

7. The wearable object according to claim 1, wherein the elastic casing elements are configured to be reversible and enable a release of an axial position of the hooking heads without damaging one of elements forming the elastic casing elements.

8. The wearable object according to claim 1, wherein the bracelet comprises two strands, each of the strand comprising the hooking head forming an end of the strand, and wherein the respective hooking head is integral with the respective strand of the bracelet.

9. The wearable object according to claim 1, wherein the hooking heads are made of polymer material.

10. The wearable object according to claim 1, wherein the hooking heads are made of thermoplastic elastomer.

11. The wearable object according to claim 1, wherein the middle of the case is made of thermoplastic.

12. The wearable object according to claim 1, wherein the fastening system is configured to enable fitting of the bracelet either by a first end or by a second end of the longitudinal cavity.

13. The wearable object according to claim 1, wherein the longitudinal cavities extend over two circular segments of the middle located at 6 o'clock and at 12 o'clock.

14. The wearable object according to claim 1, wherein the wearable object is a wristwatch.

15. A wearable object comprising:

a case having a middle, a bracelet, and a fastening system for removably securing each end of said bracelet to the middle, the middle comprising two longitudinal cavities configured to form a slide-bar, each of the end of the bracelet comprising a hooking head of complementary shape and configured to cooperate by sliding with one of the longitudinal cavities to form the fastening system, wherein the fastening system comprises elastic casing elements to bolt an axial movement of said hooking head inside the longitudinal cavity, the elastic casing elements comprising:

a rigid bolting protrusion, arranged on an inner wall of each of the longitudinal cavities, cooperating with;

two obstacles arranged in a vicinity of an elastic portion of the hooking heads, the obstacles delimiting an inter-obstacle space designed to receive the bolting protrusion and form locking elements of the bolting protrusion;

the elastic casing elements being configured to elastically distort the elastic portion of the hooking head during an insertion of the bracelet, so as to allow a passage of the bolting protrusion beyond the obstacles and lock the bolting protrusion in the inter-obstacle space bolting the axial movement of the hooking head by elastic return of the elastic portion, wherein the elastic portion of the hooking heads is a zone of lesser thickness formed by a hollow arranged at an end of the hooking heads.

16. A wearable object comprising:

a case having a middle, a bracelet, and a fastening system for removably securing each end of said bracelet to the middle, the middle comprising two longitudinal cavities configured to form a slide-bar, each of the end of the bracelet comprising a hooking head of complementary shape and configured to cooperate by sliding with one of the longitudinal cavities to form the fastening system, wherein the fastening system comprises elastic casing elements to bolt an axial movement of said hooking head inside the longitudinal cavity, the elastic casing elements comprising:

a rigid bolting protrusion, arranged on an inner wall of each of the longitudinal cavities, cooperating with;

two obstacles arranged in a vicinity of an elastic portion of the hooking heads, the obstacles delimiting an inter-obstacle space designed to receive the bolting protrusion and form locking elements of the bolting protrusion;

the elastic casing elements being configured to elastically distort the elastic portion of the hooking head during an insertion of the bracelet, so as to allow a passage of the bolting protrusion beyond the obstacles and lock the bolting protrusion in the inter-obstacle space bolting the axial movement of the hooking head by elastic return of the elastic portion, wherein the two obstacles arranged in the vicinity of the elastic portion of the hooking heads have a ramp wherein thicker portions of the ramps delimit the inter-obstacle space.

17. The wearable object according to claim 16, wherein the ramps have an inclined plane oriented in a direction of sliding of the hooking head in the longitudinal cavity.

* * * * *